United States Patent [19]

Abildgaard et al.

[11] Patent Number: 4,620,724

[45] Date of Patent: Nov. 4, 1986

[54] BINDING STRIPS FOR RECTANGULAR HOLE PUNCHED PAPER

[75] Inventors: William H. Abildgaard, Redwood City; Elmer G. Szanto, Saratoga, both of Calif.

[73] Assignee: Velo-Bind, Inc., Sunnyvale, Calif.

[21] Appl. No.: 812,621

[22] Filed: Dec. 23, 1985

Related U.S. Application Data

[63] Continuation-in-part of Ser. No. 635,187, Jul. 27, 1984.

[51] Int. Cl.[4] ..... B42D 1/00; B42B 5/08; B42B 5/14; B42B 5/16

[52] U.S. Cl. ..... 281/15 R; 281/21 R; 412/6; 412/7; 412/43

[58] Field of Search ..... 281/21 R, 28, 15 R; 412/43, 42, 9, 6, 7

[56] References Cited

U.S. PATENT DOCUMENTS

| | | | |
|---|---|---|---|
| 3,744,821 | 7/1973 | Abildgaard et al. | 412/43 X |
| 3,972,085 | 8/1976 | Giulie | 412/43 |
| 4,369,013 | 1/1983 | Abildgaard et al. | 412/43 X |

*Primary Examiner*—Paul A. Bell

*Attorney, Agent, or Firm*—Julian Caplan

[57] ABSTRACT

Heretofore, there have been two common systems of strip binding. One uses paper punched with rectangular holes and curled plastics combs having fingers passing through the holes. The other uses round holes in the paper and male and female strips, the studs of the male strips fitting through the holes in the paper and in the female strips. Excess stud length is cut off and rivet heads formed to make a permanent bind. The present invention uses rectangular punched paper similar to the first systems and strips generally similar to the second system. At least two studs and female strip holes are offset to prevent lateral displacement of the paper.

17 Claims, 5 Drawing Figures

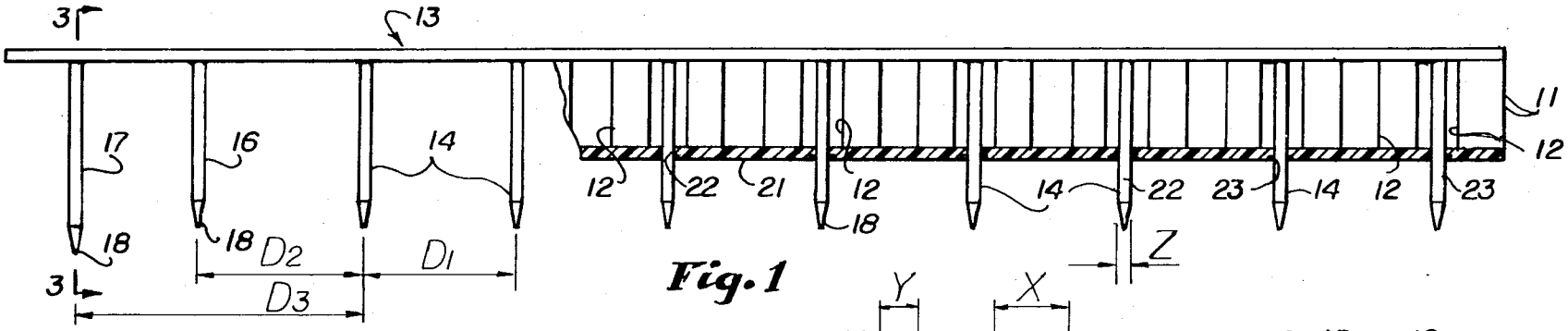
Fig. 1
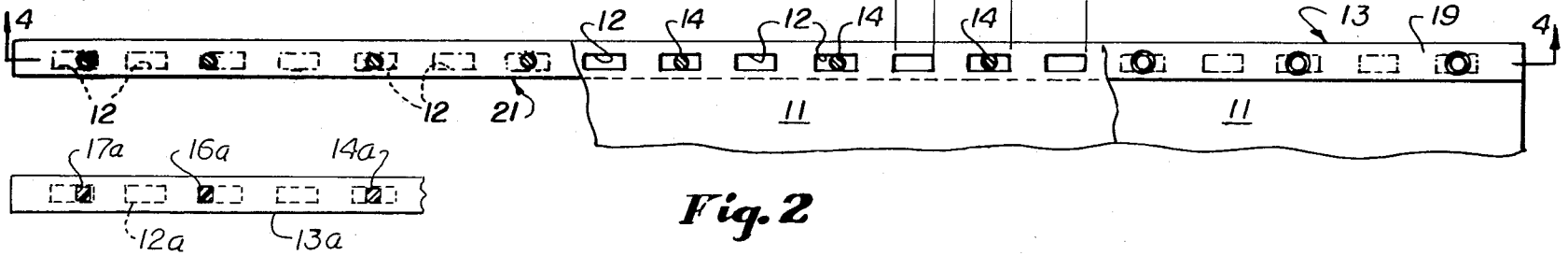
Fig. 2
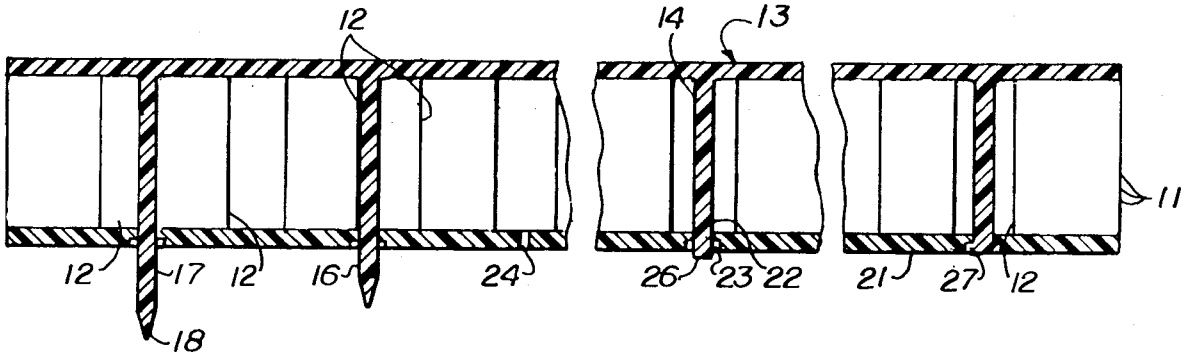
Fig. 4
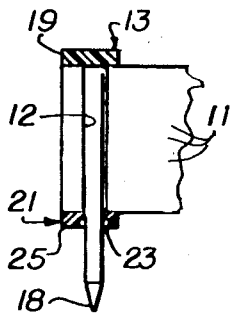
Fig. 3
Fig. 5

BINDING STRIPS FOR RECTANGULAR HOLE PUNCHED PAPER

This application is a continuation-in-part of pending application U.S. Ser. No. 06/635,187, filed July 27, 1984.

This invention relates to new and improved binding strips for rectangular hole punched paper.

A commonly used binding system initially produced by General Binding Corporation, (herein GBC) includes punches which cut elongated rectangular holes adjacent the spine edge of paper. Another common binding system produced by Velo-Bind Inc. (herein Velo-Bind) uses plastic strips, one strip having studs fitting through holes in the paper and the other strip, the excess lengths of which are cut and riveted. The holes of the Velo-Bind System are round as are the cross-sections of the studs.

There are a number of advantages of the Velo-Bind system as compared with the GBC system, including the following:

The bind is tight.

The book is not as thick at the spine.

The bind is permanent in that sheets may not be inserted and removed without debinding the strips.

The strips used with the Velo-Bind system are less expensive than the strips of the GBC system.

The present invention uses the Velo-Bind system with paper punched with holes compatible with the GBC system. Thus, the customer has the choice of binding rectangular hole paper either with the GBC system or the Velo-Bind system binding elements. Only a GBC type punch is required.

In accordance with the present invention, the stud diameter is substantially less than the length of the holes, although only slightly less than the width of the holes. To prevent lateral sliding of the sheets relative to each other, at least two studs of the Velo Bind male strips are offset relative to the remaining studs and the holes in the female strip are correspondingly offset. One of the offset studs abuts one end of one of the rectangular holes, while the second stud abuts the opposite end of a second hole. Thus, tendency of the sheets to slide is restrained.

It has been found that conventional punches locate the longitudinal rectangular holes varying distances from the spine edges of the sheets. To conceal what would otherwise be unsightly exposed edges of the sheets, the studs of the male strip are offset relative to the longitudinal center line and holes of the female strip are correspondingly offset. Thus, the strips have lateral extensions extending toward the spine edge of the book which cover any portion of the sheet which might be exposed under the strips were it not for such offsets.

To properly locate the female strip in the recess of the Velo-Bind binding machine, it has been customary to provide a pin extending upright at a specific location in such recess which is received in a locating pin hole in the female strip. Accordingly, the female strip of the present invention has such a locating hole and this hole locates the strip laterally, but also locates it so that the lateral extension of the female strip is properly oriented toward what will become the spine edge of the book. To insure that the male strip is oriented in the proper direction relative to the female strip, one of the studs is made longer than the others, so that the operator will know which end of the male strip is to be placed nearest one end of the binding machine.

Another feature of the invention is the fact that the Velo-Bind binding machine need be altered very slightly in order to accommodate the strips hereinafter described in detail. The spacing of the studs requires relocation of cut-off knives, head forming fingers and actuators therefor, but otherwise the machines require no major revision.

Other objects of the present invention will become apparent upon reading the following specification and referring to the accompanying drawings in which similar characters of reference represent corresponding parts in each of the several views.

In the drawings:

FIG. 1 is an end elevational view of a book in accordance with the present invention prior to cutting and heading the studs, the book being partly cut away to improve illustration of the subject matter.

FIG. 2 is a bottom plan view in accordance with the present invention broken away in several locations more completely to reveal the construction.

FIG. 3 is a sectional view taken substantially along the line 3—3 of FIG. 1;

FIG. 4 is an enlarged sectional view taken substantially along the line 4—4 of FIG. 2 showing various stages in the cutting and heading of the studs.

FIG. 5 is a fragmentary view similar to FIG. 3 of a modification.

The paper 11 used in accordance with the present invention is punched with a GBC type punch forming elongated rectangular holes 12 adjacent the spine edge of each sheet. Holes 12 are of uniform length "y" and are spaced apart a uniform distance "x". The holes 12 are spaced inward from the spine edge a predetermined distance but, the punching operation sometimes results in such distances varying from the desired predetermined standard.

Male strips 13, are fabricated of a plastic which is preferably thermoplastic. One suitable plastic is a semi-rigid polyvinyl chloride. In a preferred embodiment of the invention, such strips are approximately $\frac{1}{4}$ inches wide and 0.070 inches thick. Integral with and depending from the strip 13 at approximately $1\frac{1}{8}$ inch intervals are studs 14 having tapered points 18. The studs are approximately 0.095 inches in diameter. Various lengths of studs may be used depending on the anticipated thickness of the book to be formed.

Stud diameters are indicated in the accompanying drawings as "z" and are uniform. The distance between studs 14 is $D_1$; between studs 14 and 16 $D_2$; between the nearest stud 14 and stud 17 is $D_3$. Thus, as best shown in FIG. 2, when the studs are inserted in the holes 12 of a stack of sheets, the stud 17 engages the right-hand edge of the leftmost hole 12 while the stud 16 engages the left-hand edge of the third endmost stud. The remaining studs 14 are located approximately in the centers of respective holes 12. Studs 14, 16, 17 are shown round in FIGS. 1–3. However, as shown in FIG. 5 the studs 14*a*, 16*a*, and 17*a* may be square or other shape. It is understood, of course, that the dimension "z" must be substantially less than "y". As is apparent from FIG. 2, there are preferably only one-half as many studs 14, 16, 17 as there are holes 12.

Since, as has been stated, sometimes the holes 12 are located at varying distances from the spine edges of the paper 11, as best shown in FIG. 3, the strip 13 is formed with an extension 19 toward the spine edge of the book which conceals the edge of the paper 11 which might otherwise be exposed outside the strip 13.

Female strip 21 is formed with regularly spaced holes at intervals corresponding to the spacing of the studs 14. The two endmost holes in strip 21 are aligned with the studs 17 and 16. Preferably, each hole 22 is formed on the underside of strip 22 with a counterbore 23 or a countersink. The female strips are formed with lateral extensions 25 corresponding to the extensions 19 of the male strip 13.

To assist in locating the female strip in the binding machine, which may be any of the machines shown in U.S. Pat. Nos. 3,756,625, 3,800,146 and 3,994,035 or 4,270,970, or other similar machines, a locating hole 24 of a smaller diameter than the holes 22 is formed to receive a locating pin such as the pin 102 shown in FIG. 11 of U.S. Pat. No. 4,270,970. This locates the female strip 21 laterally relative to the machine and also insures that the extension 25 is oriented in proper direction. To insure that the male strip 13 is properly located, it will be noted that the end pin 17 is considerably longer than the pin 14 at the opposite end.

Thus, with any of the Velo-Bind machines heretofore mentioned, the female strip 21 is located in proper position. Sheets 11 are positioned on top of the strip 21. Strip 13 is then positioned, the studs 14, 16, 17 passing through the holes 12 in the sheets 11 and the holes 22 in the strip 21. Stud 17 engages the right-hand end of the leftmost hole 12. Stud 16 engages the left end of the third inmost hole 12. Initially, the points 18 extend well below the strip 21 and pressure is applied in accordance with the Velo-Bind binding system to the strip 13, compressing the sheets between the strips 13 and 21 (FIG. 4, left-hand end). The machine then cuts off the excess lengths of the studs 14, 16, 17, leaving stubs 26 (see middle of FIG. 4). Thereupon the machine forms a rivet head 27 filling the counterbore 23. (FIG. 4, right-hand end).

What is claimed is:

1. A book comprising a plurality of sheets, each formed vicinal their spine edges with a plurality of substantially identical elongated apertures, said apertures being equally spaced apart a first distance x and being longitudinally elongated a second distance y, a pair of binding strips, a first said strip having a plurality of first studs extending therefrom, each having a longitudinal dimension z substantially less than y spaced apart from each other a distance ax where a is an integer and at least one second stud aligned with said first studs and having a longitudinal dimension substantially less than y, said second stud being spaced from one said first stud a distance substantially equal to $ax+\frac{1}{2}(y-z)$ and at least one third stud aligned with said first studs and having a longitudinal dimension substantially less than y, said third stud being spaced from one said first stud a distance substantially equal to $bx-\frac{1}{2}(y-z)$ where b is an integer which may be the same as or different from a and a second strip formed with holes spaced and dimensioned to receive said studs, said studs extending through said apertures and said holes, said second stud engaging a first short edge of one said aperture, said third said stud engaging a second short edge of another said aperture opposite said first edge, said studs being fixed to said second strip.

2. A book according to claim 1 in which said second strip is formed with enlargements around said holes on the surface of said second strip opposite said sheets, the ends of said studs filling said enlargements.

3. A book according to claim 1 in which said strips have parallel side edges, one side edge of said first strip being further from said studs than the other side of said first strip; one side edge of said second strip being further from said holes than the other side edge of said second strip, whereby said one side edges extend out to the spine edges of said sheets.

4. A book according to claim 1 in which said second strip is formed with a locating hole of different size than said first-mentioned holes and located between two of said first-mentioned holes.

5. A book according to claim 1 in which said studs are round.

6. A book according to claim 5 in which one said stud is initially noticeably longer than the other said studs.

7. A method of forming a book comprising providing a plurality of sheets each formed vicinal their spine edges with a plurality of substantially identical elongated apertures, said apertures being equally spaced apart a first distance x and being longitudinally elongated a second distance y, aligning said sheets with said apertures in registry, providing a pair of binding strips, a first said strip having a plurality of first studs extending therefrom, each having a longitudinal dimension z substantially less than y spaced apart from each other a distance ax where a is an integer and at least one second stud aligned with said first studs and having a longitudinal dimension substantially less than y, said second stud being spaced from one said first stud a distance substantially equal to $ax+\frac{1}{2}(y-z)$ and at least one third stud aligned with said first studs and having a longitudinal dimension substantially less than y, said third stud being spaced from one said first stud a distance substantially equal to $bx-\frac{1}{2}(y-z)$ where b is an integer which may be the same as or different from a and a second strip formed with holes spaced and dimensioned to receive said studs, inserting said studs through said apertures and said holes, said second stud engaging a first short edge of one said aperture, said third said stud engaging a second short edge of another said aperture opposite said first edge, cutting off excess lengths of said studs and securing said studs to said second strip.

8. A method according to claim 4 in which said strips have parallel side edges, one side edge of said first strip being farther from said studs than the other side edge of said first strip; one side edge of said second strip being farther from said holes than the other side edge of said second strip, said one side edge extending out to the spine edge of said book.

9. A method according to claim 4 in which said studs are theremoplastic and said second strip is formed with enlargements around said holes on the surface of said second strip opposite said sheets, said step of securing said studs comprising forming heads on said studs filling said enlargements.

10. A method according to claim 9 in which said second strip is formed with a locating hole and which further comprises locating said second strip longitudinally relative to a support by means of a pin fitting into said locating hole, then aligning said sheets with some of said apertures overlying said first mentioned holes.

11. A pair of binding strips for use with sheets formed vicinal their spine edges with a plurality of substantially identical holes, said holes being equally spaced apart a distance x and being longitudinally elongated a second distance y, said strips comprising a first strip having a plurality of first studs, each having a longitudinal dimension z substantially less than y extending therefrom spaced apart from each other a distance ax where a is an integer and at least one second stud aligned with said first studs and having a longitudinal dimension substantially less than y, said second stud being spaced from one said first stud a distance substantially equal to $ax+\frac{1}{2}(y-z)$ and at least one third stud aligned with said first studs and having a longitudinal dimension substantially less than y, said third stud being spaced from one said first stud a distance substantially equal to $bx-\frac{1}{2}(y-z)$ where b is an integer which may be the same as or different from a and a second strip formed with second holes spaced and dimensioned to receive said studs.

12. Strips according to claim 11 in which said second strip is formed with enlargements around said second holes on one surface of said second strip.

13. Strips according to claim 11 in which the difference between said second and third distances is approximately the length of a conventional longitudinally elongated rectangular hole for binding papers.

14. Strips according to claim 11 in which said studs are round.

15. Strips according to claim 11 in which said second strip is formed with a locating hole of different size than said first-mentioned holes and located between two of said first-mentioned holes.

16. Strips according to claim 11 having parallel side edges, one side edge of said first strip being farther from said studs than the other side edge of said first strip; one side edge of said second strip being further from said holes than the other side edge of said second strip.

17. Strips according to claim 16 in which one said stud is noticeably longer than the other said studs.

* * * * *